US012144478B2

(12) United States Patent
Rupp et al.

(10) Patent No.: US 12,144,478 B2
(45) Date of Patent: Nov. 19, 2024

(54) SYSTEM COMPRISING A DISHWASHER, METHOD FOR OPERATING A DISHWASHER, AND COMPUTER PROGRAM PRODUCT

(71) Applicant: BSH Hausgeräte GmbH, Munich (DE)

(72) Inventors: Michael Rupp, Holzheim (DE); Kai Paintner, Welden (DE); Kuldeep Narayan Singh, Dillingen a.d. Donau (DE); Tobias Späth, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 18/021,221

(22) PCT Filed: Sep. 9, 2021

(86) PCT No.: PCT/EP2021/074752
§ 371 (c)(1),
(2) Date: Feb. 14, 2023

(87) PCT Pub. No.: WO2022/058223
PCT Pub. Date: Mar. 24, 2022

(65) Prior Publication Data

US 2023/0292978 A1 Sep. 21, 2023

(30) Foreign Application Priority Data

Sep. 15, 2020 (DE) ..... 10 2020 211 543.5

(51) Int. Cl.
*A47L 15/00* (2006.01)
*A47L 15/42* (2006.01)

(52) U.S. Cl.
CPC ..... *A47L 15/0021* (2013.01); *A47L 15/4295* (2013.01); *A47L 15/006* (2013.01); *A47L 2401/04* (2013.01); *A47L 2501/26* (2013.01)

(58) Field of Classification Search
None
See application file for complete search history.

(56) References Cited

U.S. PATENT DOCUMENTS 11,058,280 B2 7/2021 Yoshimoto
2012/0138092 A1* 6/2012 Ashrafzadeh ..... A47L 15/4295 134/57 D (Continued)

FOREIGN PATENT DOCUMENTS

CN 111568327 A 8/2020
DE 102018009311 A1 5/2020

OTHER PUBLICATIONS

National Search Report DE 10 2020 211 543.5 dated Jul. 16, 2021, 1 page, not in English.

(Continued)

*Primary Examiner* — Eric W Golightly
(74) *Attorney, Agent, or Firm* — Michael E. T'scupp; Andre Pallapies; Brandon G. Braun

(57) ABSTRACT

A system includes a dishwasher including a receptacle for items to be washed, a control apparatus configured to execute a wash program in dependence upon a loading of the receptacle with items to be washed and a camera configured to capture an image of at least one partial region of the receptacle in dependence upon a pull-out position of the receptacle. The captured image is stored by the control apparatus in dependence upon the pull-out position in a memory location of a number of memory locations, which memory location is assigned to the pull-out position, with each of the number of memory locations being assigned a set of pull-out positions. An image analysis unit determines the loading of the receptacle in dependence upon images that are stored in the memory locations.

18 Claims, 6 Drawing Sheets

(56) References Cited

U.S. PATENT DOCUMENTS

| | | | | |
|---|---|---|---|---|
| 2014/0035855 | A1* | 2/2014 | Feldman | G06F 3/0488<br>345/173 |
| 2018/0214001 | A1 | 8/2018 | Wöbkemeier | |
| 2019/0200841 | A1 | 7/2019 | Yoshimoto | |

OTHER PUBLICATIONS

International Search Report PCT/EP2021/074752 dated Nov. 30, 2021, 16 pages, not in English.

* cited by examiner

SYSTEM COMPRISING A DISHWASHER, METHOD FOR OPERATING A DISHWASHER, AND COMPUTER PROGRAM PRODUCT

CROSS-REFERENCES TO RELATED APPLICATIONS

This application is the U.S. National Stage of International Application No. PCT/EP2021/074752, filed Sep. 9, 2021, which designated the United States and has been published as International Publication No. WO 2022/058223 A1 and which claims the priority of German Patent Application, Serial No. 10 2020 211 543.5, filed Sep. 15, 2020, pursuant to 35 U.S.C. 119 (a)-(d).

The contents of International Application No. PCT/EP2021/074752 and German Patent Application, Serial No. 10 2020 211 543.5 are incorporated herein by reference in their entireties as if fully set forth herein.

BACKGROUND OF THE INVENTION

The present invention relates to a system having a dishwasher, a method for operating a dishwasher and a computer program product.

Known dishwashers are configured so as to execute a wash program in an optimum manner on the basis of a loading of the dishwasher. In this case, an adjustment is made for example to a wash liquor temperature, a pump rotational speed and/or a cleaning agent in dependence upon a type of item to be washed. The loading of the dishwasher can be determined by means of an image recognition based on an image of a receptacle for items to be washed. For this purpose, the camera is suitable, for example, for capturing and storing an image that is suitable for the image recognition.

WO 2018/044094 A1 discloses a dishwasher having a camera that is configured so as to capture an image of a receptacle for items to be washed. The receptacle for items to be washed has a marking by means of which a position of the receptacle for items to be washed is determined on the basis of the image. Furthermore, the item to be washed that is visible in the captured image is recognized.

BRIEF SUMMARY OF THE INVENTION

Based on this background, an object of the present invention is to improve the operation of a dishwasher.

In accordance with a first aspect, a system having a dishwasher, in particular a household dishwasher is proposed. The system comprises a control apparatus for executing a wash program in dependence upon a loading of a receptacle for items to be washed of a dishwasher with items to be washed, and a camera for capturing an image of at least one partial region of the receptacle for items to be washed in dependence upon a pull-out position of the receptacle for items to be washed, wherein the control apparatus is configured so as, as the image is captured, to store the captured image in dependence upon the pull-out position in a memory location of a number of memory locations that is assigned to the pull-out position. Each memory location of the number is assigned a set of pull-out positions. Moreover, the system comprises an image analysis unit for determining a loading of the receptacle for items to be washed in dependence upon the images that are stored in the memory locations.

This system has the advantage that different memory locations are provided for images on which different partial regions of the receptacle for items to be washed are visible. Consequently, it is possible to reduce the amount of memory required since each memory location stores in particular only one individual image. In this case, the stored image is in particular the most recent image that displays the respective partial region. A further advantage is that it is possible to reduce a number of images that must be analyzed in order to determine the loading. In particular, it is sufficient for a respective partial region to analyze only the most recent image on which the partial region is visible. Consequently, it is possible to reduce computing power required and/or computing time.

The control apparatus can be implemented using hardware technology and/or software technology. When implemented using hardware technology, the control apparatus can be designed for example as a computer or as a microprocessor. When implemented using software technology, the control apparatus can be designed as a computer program product, as a function, as a routine, as part of a program code or as an executable object.

The control apparatus is configured so as to execute the wash program in dependence upon the loading. In other words, the control apparatus adapts or changes a sequence of the wash program and/or individual parameter values of an in part pre-determined wash program. The sequence comprises in particular a sequence of subprogram steps, such as a pre-wash step, a main wash step, a rinsing step and a drying step. The parameter values comprise in particular a duration of a respective subprogram step, a wash liquor volume, a wash liquor temperature, a quantity of cleaning agent to be added, points in time at which the cleaning agent is to be added, a circulating pump rotational speed, an adjustment of a water softness, an adjustment of a water hardness and so forth. For example, if the loading comprises to a large extent glass items, it is possible to set a higher degree of water hardness and reduce a circulating pump rotational speed in comparison to a loading that comprises mainly ceramic items and/or metal items.

The dishwasher comprises for example a dishwasher interior in which is arranged at least one receptacle for items to be washed that is mounted in such a manner that it can be pulled out. When the door of the dishwasher is open, the receptacle for items to be washed can be pulled out and this renders it possible for the receptacle for items to be washed to be loaded comfortably with items to be washed.

The dishwasher has, for example, on the upper edge of the dishwasher cavity a camera that is configured so as to capture a region that is determined by the movement radius of the receptacle for items to be washed. The camera comprises in particular a wide angle objective and is configured so as to capture a large spatial angle. In particular, the camera is configured so as to capture the entire receptacle for items to be washed if this is in the fully pulled out state, in other words is in a maximum pull-out position. It is preferred that the camera is activated by the door being opened and provides an image stream to the control apparatus. The image stream comprises images that are captured sequentially, wherein a specific image capturing rate is predetermined. The images are transmitted in particular unprocessed in the form of raw data from the camera to the control apparatus. The control apparatus assumes the further processing, in other words, for example, the decision as to whether an image is to be stored or discarded. The camera can therefore be constructed in a comparatively simple manner and has only a low resource requirement. Consequently, the camera can be particularly cost-effective. The camera can be configured so as to capture an image in an infrared spectral range, a visual spectral range and/or in an ultraviolet spectral range.

It is to be noted that in embodiments in lieu of the control apparatus the camera can process the captured images.

In preferred embodiments, the dishwasher comprises multiple receptacles for items to be washed and said receptacles for items to be washed are arranged in particular in a vertical manner one above the other in the dishwasher. If the dishwasher has multiple receptacles for items to be washed, then the features and/or explanations above and below apply for each receptacle for items to be washed where relevant.

The image that is captured by the camera displays a partial region of the receptacle for items to be washed. The partial region that is visible on the image depends upon the current pull-out position of the receptacle for items to be washed and the field of view of the camera. For example, the field of view of the camera is fixed in such a manner that in the case of a completely pushed in receptacle for items to be washed only a front edge of the receptacle for items to be washed, for example a handle of the receptacle for items to be washed, is visible on the image. If the receptacle for items to be washed is now pulled out, a larger partial region of the receptacle for items to be washed slowly appears in the field of view of the camera. If the receptacle for items to be washed is pulled out for example up to half, approximately half of the receptacle for items to be washed is visible on the image.

Depending upon which partial region is visible on the captured image, the image of the control apparatus is stored in an assigned memory location. In this case, the current pull-out position of the receptacle for items to be washed is used as an indicator for the visible partial region. The number of memory locations is preferably limited, in particular fewer than ten memory locations, preferably fewer than five memory locations, are provided for a respective receptacle for items to be washed. Consequently, it is possible to significantly reduce the amount of memory required to store the images. Each captured image is stored in particular together with a time stamp that it receives at a time when the image is captured.

The image analysis unit is configured so as to determine the loading of the respective receptacle for items to be washed on the basis of the captured images. The image analysis unit can for this purpose use, for example, methods of signal analysis, pattern recognition, image recognition, image classification and the like. The image analysis unit can perform the determination at least in part on the basis of artificial intelligence, such as a trained neural network.

It is preferred that in each case the image analysis unit only analyzes the most recent images of a respective partial region. For example, it is possible that a more recent image is available for a front partial region of the receptacle for items to be washed than an image that displays the entire receptacle for items to be washed. This is particularly the case if the user of the dishwasher has only pulled out in part the receptacle for items to be washed in order to load the front region of the receptacle for items to be washed. In this case, the image analysis unit will, for example, analyze the image that displays the entire receptacle for items to be washed and the more recent image that displays the front partial region. Further images that, for example, display larger or also smaller partial regions than the front partial region and which are older, are on the other hand preferably not analyzed since these comprise outdated and/or redundant information. The loading of the front partial region is determined on the basis of the more recent image, the loading of the remaining partial region of the receptacle for items to be washed is determined on the basis of the image of the entire receptacle for items to be washed. Consequently, the current loading is determined for each partial region, wherein the required computing power and/or computing time are reduced.

The loading is only determined if the user of the dishwasher starts the wash program. Since it is necessary in each wash program to first add wash liquor into the dishwasher interior, sufficient time is still available for this without the execution of the wash program being delayed.

In accordance with one embodiment of the system, the control apparatus is configured so as to identify an image position of a feature of the receptacle for items to be washed in the first captured image and so as to determine the pull-out position of the receptacle for items to be washed in dependence upon the identified image position of the feature of the receptacle for items to be washed.

This embodiment has the advantage that the current pull-out position of the receptacle for items to be washed is automatically recognized by the control apparatus on the basis of the captured images without an additional apparatus being required. Different receptacles for items to be washed have, for example, different features or different positions of the features. A feature is in particular a specific pattern or a specific structure. The feature can be visible, for example, only in a specific spectral range, for example only in the infrared spectral range.

In accordance with a further embodiment of the system, the control apparatus is configured so as to identify the image position of the feature of the receptacle for items to be washed in dependence upon an area of interest of the image.

This embodiment has the advantage that the control apparatus only needs to analyze some of the images for the feature and for this reason the amount of data that is to be processed is reduced. The required computing power and/or a computing duration are consequently reduced.

In accordance with a further embodiment of the system, the feature of the receptacle for items to be washed comprises a handle of the receptacle for items to be washed for manually pulling out the receptacle for items to be washed and for manually pushing in the receptacle for items to be washed into the dishwasher and/or a marking that is arranged on the handle.

This is advantageous since an additional structure is not required in order to provide the feature.

In accordance with a further embodiment of the system, the control apparatus is configured so as to store the respective most recent image of the receptacle for items to be washed in the case of a specific pull-out position in the memory location that is assigned to the specific pull-out position.

The most recent image is the image that has been captured more recently. Insofar as the control apparatus processes the image stream of the camera sequentially, the image that has just been processed is always the most recent image and for this reason the control apparatus stores said image in the assigned memory location and consequently overwrites an image that is already stored in said memory location. If the processing is not performed sequentially and time delays can occur, it is possible to provide that, before the control apparatus stores a candidate image in an assigned memory location, said control apparatus compares the time stamp of the candidate image and of the image that is already stored and stores the more recent of the two images.

In accordance with a further embodiment of the system, a specific interval from the set of possible pull-out positions of the receptacle for items to be washed is assigned to each memory location.

The specific interval corresponds to the partial region of the respective receptacle for items to be washed that is visible on the captured image. For example, in the case of a pull-out position that is between 90%-100% with regard to the maximum pull-out position, a partial region comprising 90%-100% of the receptacle for items to be washed is visible on a captured image. In the present case, an interval is understood to mean in particular an associated value range. All specific intervals can together, but do not have to, include all possible pull-out positions. Images that are captured without pull-out positions being recorded are accordingly discarded and not stored.

In accordance with a further embodiment of the system, at least two memory locations are provided, wherein a first interval that is assigned to a first memory location comprises a maximum pull-out position of the receptacle for items to be washed and has a first width, a second interval that is assigned to a second memory location adjoins the first interval and has a second width, wherein the first width is narrower than the second width.

The first width is preferably comparatively small, for example comprises only 5%-10% of the entire pull-out region. This embodiment has the advantage that an image that displays the entire receptacle for items to be washed (maximum pull-out position) is not replaced or overwritten by an image on which the receptacle for items to be washed is only visible in part. Consequently, advantageously an image of the entire receptacle for items to be washed is available in most cases. By virtue of the fact that the second interval is selected to be wider, the number of required memory locations can be effectively reduced while at the same time covering the greatest possible area of the pull-out region.

In accordance with a further embodiment of the system, the camera is configured so as to capture an image stream of the receptacle for items to be washed, wherein two images in chronological order in the image stream have a predetermined temporal spacing, and wherein the control apparatus is configured so as in dependence upon two successive images of the image stream to determine a movement of the receptacle for items to be washed and to store one of the two successive images in dependence upon a determined movement.

In this embodiment, it is advantageously possible to forego a camera that comprises a mechanical shutter or a complex electronic shutter. Images that are blurred as a result of a movement of the receptacle for items to be washed and that are therefore unsuitable for image analysis are recognized by the control apparatus and consequently can be discarded. The control apparatus determines the movement in particular on the basis of a change in the image position of the feature of the receptacle for items to be washed. The determination of the loading is consequently more robust.

The movement can be determined with reference to a change in the image position of the feature both in the X direction and also in the Y direction. For example, the image position is determined on the basis of a center of gravity of a planar feature. If the feature is covered in part, the center of gravity is in a different image position. This can be the case if the receptacle for items to be washed is itself not moving but a user of the dishwasher is just sorting items to be washed into the receptacle for items to be washed. Such an image is less suitable for analysis since in this case the end state has not yet been achieved and foreign objects are apparent in the image, which can falsify the determination of the loading.

In accordance with a further embodiment of the system, the image analysis unit is configured so as to determine the loading in dependence upon a capturing time which is assigned to a respective stored image and the pull-out positions that are assigned to the memory location, wherein a first image in which a specific partial region of the receptacle for items to be washed is visible and whose capturing time is more recent than the capturing time of a second image in which the specific partial region of the receptacle for items to be washed is also visible is used to determine the loading for the specific partial region of the receptacle for items to be washed.

In the case of this embodiment, in each case only the most recent image for a respective partial region is analyzed.

In accordance with a further embodiment of the system, the control apparatus is configured so as to delete an image whose capturing time is earlier than a predetermined threshold value.

The threshold value can be multiple days, for example. It is possible using this embodiment, for example, that images that have been captured even prior to a first wash program being executed are not used in order to determine the loading for a second wash program.

In accordance with a further embodiment of the system, the control apparatus is configured so as to put the camera into a sleep mode at the end of a predetermined time interval in which a state of the receptacle for items to be washed is constant.

The predetermined time interval comprises between 5 minutes and 20 minutes, for example. This has the advantage that, on the one hand, the camera can be set to an idle state so as to save energy, but on the other hand, it also ensures that current images are captured during a typical duration of loading a dishwasher.

In accordance with a further embodiment of the system, the image analysis unit is arranged in a facility that is external to the dishwasher, wherein the control apparatus and the image analysis unit are arranged so as to transmit data to each other.

In this embodiment, the dishwasher can have a less complex structure. In addition, the image analysis unit can have a particularly high computing power if it is integrated, for example, in a server that is accessible via the Internet or the like. Furthermore, utilization of the image analysis unit can be increased in that it is used by a plurality of dishwashers. Also, an update of the image analysis unit is possible in a simplified manner in this embodiment.

The control apparatus and the image analysis unit can transmit data, for example, via the Internet and/or via a mobile radio connection, such as 3G, 4G or 5G. In particular, the control apparatus transmits stored images, wherein it only transmits the respectively most recent ones as explained above. The image analysis unit receives the images, performs the analysis and transmits the determined loading to the control apparatus.

In accordance with a further embodiment of the system, the image analysis unit is configured so as to determine a type, a quantity, an orientation, an arrangement and/or a material of the item to be washed that is arranged in the receptacle for items to be washed.

In accordance with a second aspect, a method for operating a dishwasher, in particular a household dishwasher, is proposed. In a first step, an image of at least a partial region of a receptacle for items to be washed of a dishwasher is captured in dependence upon a pull-out position of the receptacle for items to be washed. In a second step, the pull-out position of the receptacle for items to be washed is determined at the time the image is captured. In a third step, the image is stored in a memory location of a number of memory locations that is associated with the pull-out position, wherein a set of pull-out positions is assigned to each memory location of the number. In a fourth step, a loading of the receptacle for items to be washed is determined in dependence upon the images that are stored in the memory locations. In a fifth step, a wash program is executed in dependence upon the determined loading.

The advantages and explanations that are explained for the proposed dishwasher apply accordingly to the method. The embodiments and features that are described for the proposed dishwasher apply accordingly to the proposed method.

Furthermore, a computer program product is proposed comprising instructions which, when the program is executed by a computer, cause the computer to perform the method that is described above.

A computer program product, such as a computer program means, can be provided or supplied, for example, as a storage medium, such as a memory card, USB flash drive, CD-ROM, DVD, or also in the form of a downloadable file from a server on a network. This can be done, for example, in a wireless communication network by transmitting a corresponding file with the computer program product or computer program means.

Other possible implementations of the invention also include combinations of features or embodiments that are described previously or below with respect to the exemplary embodiments, which are not specifically mentioned. In this regard, the person skilled in the art will also add individual aspects as improvements or additions to the respective basic form of the invention.

BRIEF DESCRIPTION OF THE DRAWINGS

Further advantageous embodiments and aspects of the invention are the subject matter of the subordinate claims as well as the exemplary embodiments of the invention that are described below. In the following, the invention will be explained in more detail with the aid of preferred embodiments with reference to the accompanying figures.

DETAILED DESCRIPTION OF EXEMPLARY EMBODIMENTS OF THE PRESENT INVENTION

Figure 1:
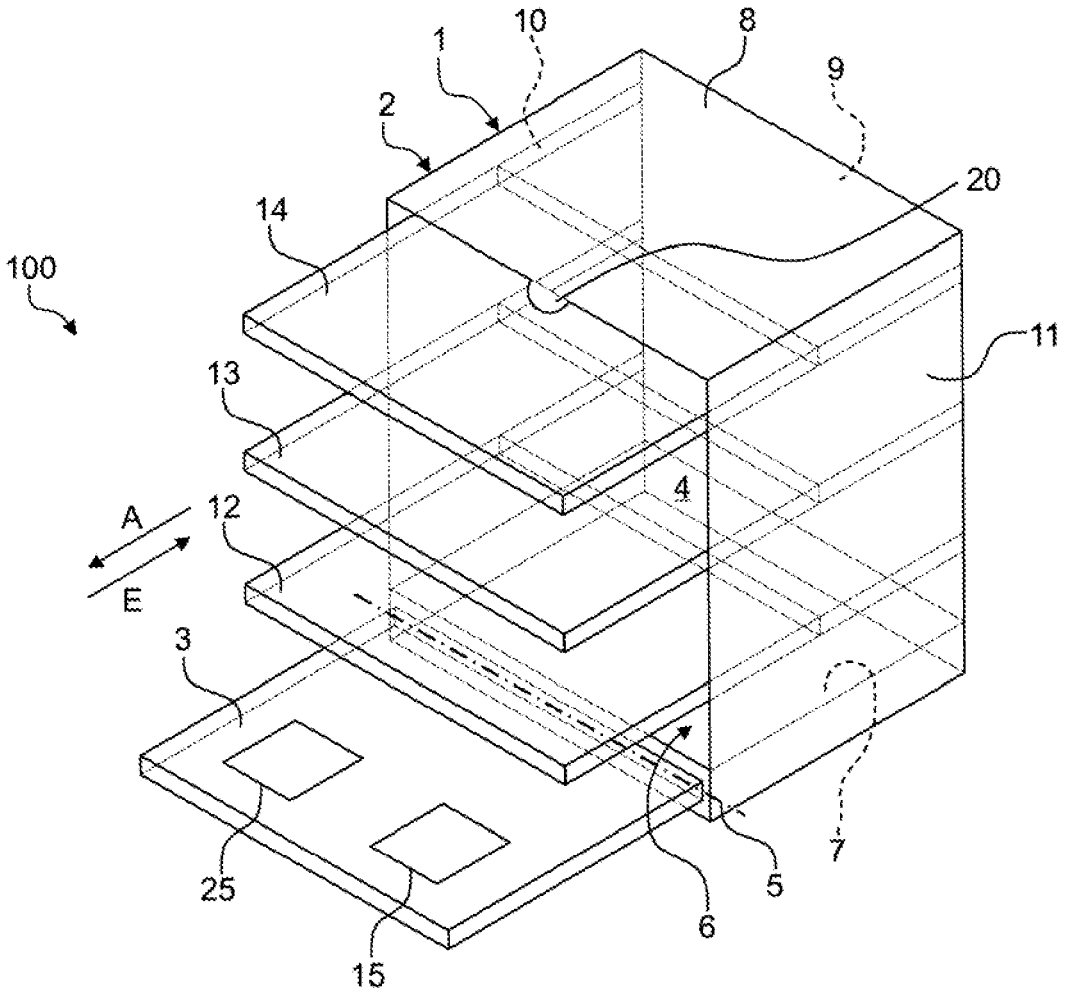
FIG. 1 shows a schematic perspective view of an embodiment of a system comprising a household dishwasher.

In the figures, identical or functionally identical elements have been given the same reference characters unless otherwise indicated.

FIG. 1 shows a schematic perspective view of an embodiment of a system 100 having a dishwasher 1, which is designed as a household dishwasher. In this example, all components of the system 100 are integrated in the household dishwasher 1. The household dishwasher 1 comprises a dishwasher cavity 2 which can be closed by a door 3, in particular in a watertight manner. For this purpose, a sealing facility can be provided between the door 3 and the dishwasher cavity 2. The dishwasher cavity 2 is preferably cuboidal. The dishwasher cavity 2 can be arranged in a housing of the household dishwasher 1. The dishwasher cavity 2 and the door 3 can form a dishwasher interior 4 for washing items to be washed.

The door 3 is shown in FIG. 1 in its open position. By pivoting about a pivot axis 5 that is provided at a lower end of the door 3, the door 3 can be closed or opened. With the aid of the door 3, a loading opening 6 of the dishwasher cavity 2 can be closed or opened. The dishwasher cavity 2 has a floor 7, a ceiling 8 that is arranged opposite the floor 7, a rear wall 9 that is arranged opposite the closed door 3 and two side walls 10, 11 that are arranged opposite each other. The floor 7, the ceiling 8, the rear wall 9 and the side walls 10, 11 can, for example, be made of a stainless steel sheet. Alternatively, for example, the floor 7 can be made of a plastic material.

The household dishwasher 1 further comprises at least one receptacle 12 to 14 for items to be washed. It is preferred that multiple, for example three, receptacles 12 to 14 for items to be washed can be provided, wherein the receptacle 12 for items to be washed can be a lower receptacle for items to be washed or a lower basket, the receptacle 13 for items to be washed can be an upper receptacle for items to be washed or an upper basket, and the receptacle 14 for items to be washed can be a cutlery drawer. As FIG. 1 further shows, the receptacles 12 to 14 for items to be washed are arranged one above the other in the dishwasher cavity 2. Each receptacle 12 to 14 for items to be washed can be moved optionally into or out of the dishwasher cavity 2. In particular, each receptacle 12 to 14 for items to be washed can be pushed into or moved into the dishwasher cavity 2 in an insertion direction E and can be pulled out of or moved out of the dishwasher cavity 2 in an extraction direction A opposite to the insertion direction E.

A camera 20 is arranged at the front edge of the ceiling 8. The field of view FOV (see FIG. 3 or 4) of the camera 20 is designed in such a way that it can fully capture a fully pulled out receptacle 12 to 14 for items to be washed. A control apparatus 15 and an image analysis unit 25 are also arranged on the door 3. The control apparatus 15 comprises a number of memory locations (not shown) for storing images IMG that are captured by the camera 20 (see FIG. 2) and is configured so as to execute a wash program in dependence upon a determined loading of the household dishwasher 1. The image analysis unit 25 is configured so as to determine the loading in dependence upon images of the receptacles 12 to 14 for items to be washed that are captured by the camera 20.

In the following, the functions of the control apparatus 15, the camera 20 and the image analysis unit 25 are explained in detail.

Figure 2:
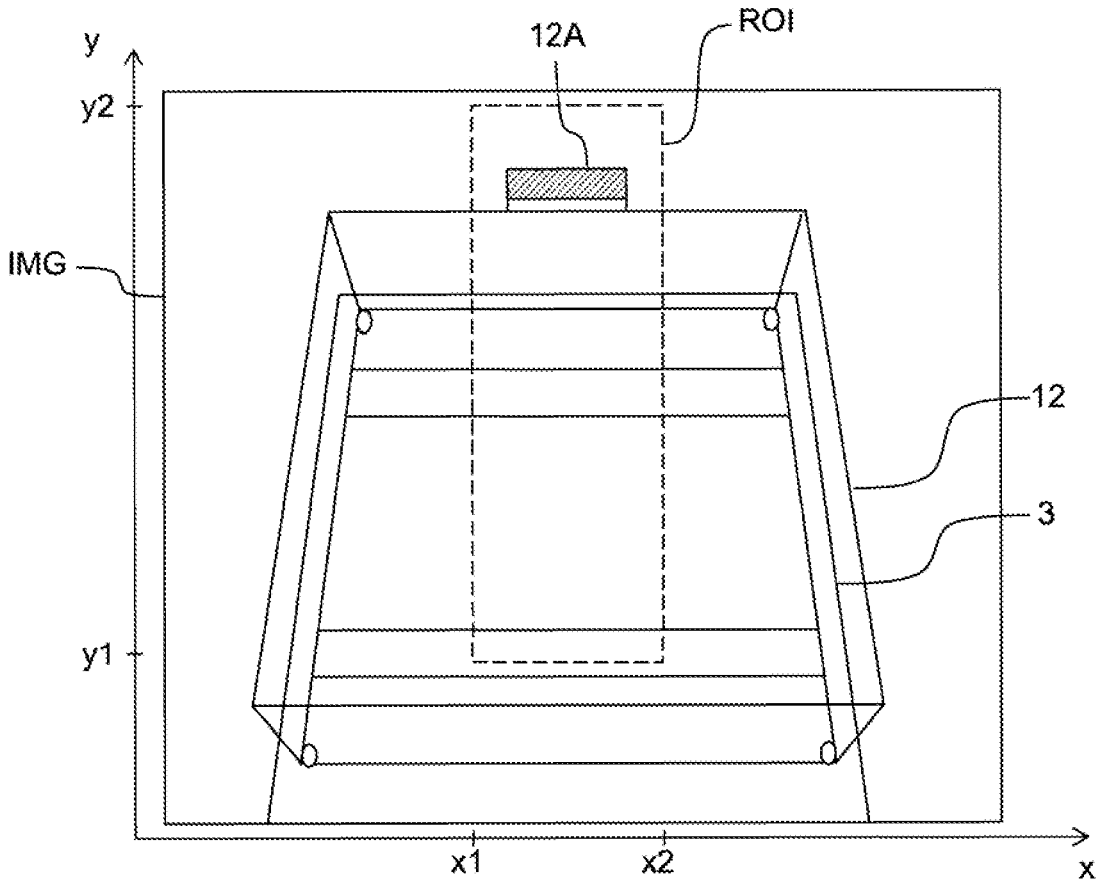
FIG. 2 shows an exemplary image of a receptacle for items to be washed.

FIG. 2 shows an exemplary image IMG of a receptacle 12 for items to be washed that has been captured, for example, by the camera 20 of FIG. 1. In the image IMG, the door 3 and the receptacle 12 for items to be washed, which is fully pulled out in this case, is visible. In addition, a handle 12A of the receptacle 12 for items to be washed is visible. For reasons of clarity, the receptacle 12 for items to be washed is shown here without items to be washed. Two coordinate axes X, Y are also shown. The image IMG has a number of pixels whose image position is uniquely determined based on the coordinates X, Y. The coordinates X1, X2, Y1, Y2 define a region of interest ROI in the image. The region of interest ROI is selected such that the handle 12A of the receptacle 12 for items to be washed moves in this region of the image IMG when the receptacle 12 for items to be washed is moved.

The control apparatus 15 (see FIG. 1) is configured so as to determine an image position of the handle 12A in the image IMG by analyzing the region of interest ROI. A respective image position or interval Z1-Z4 (see FIGS. 3-6) is assigned a memory location on which the captured image is stored. This is explained in detail below with reference to FIGS. 3-6.

Figure 3:
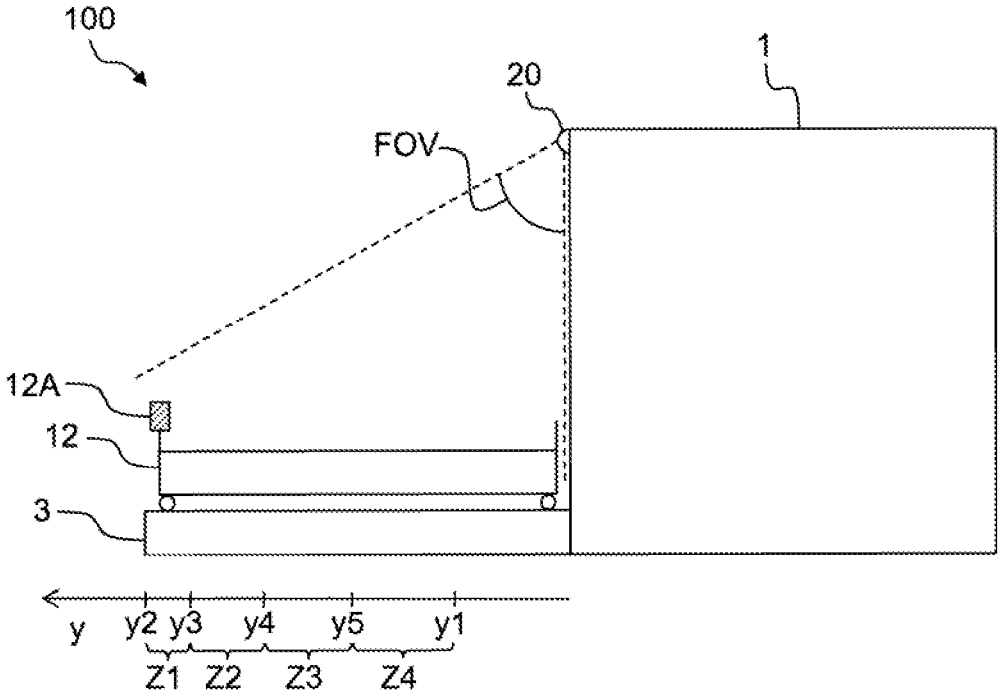
FIG. 3 shows a schematic side view of a system having a household dishwasher.
Figure 4:
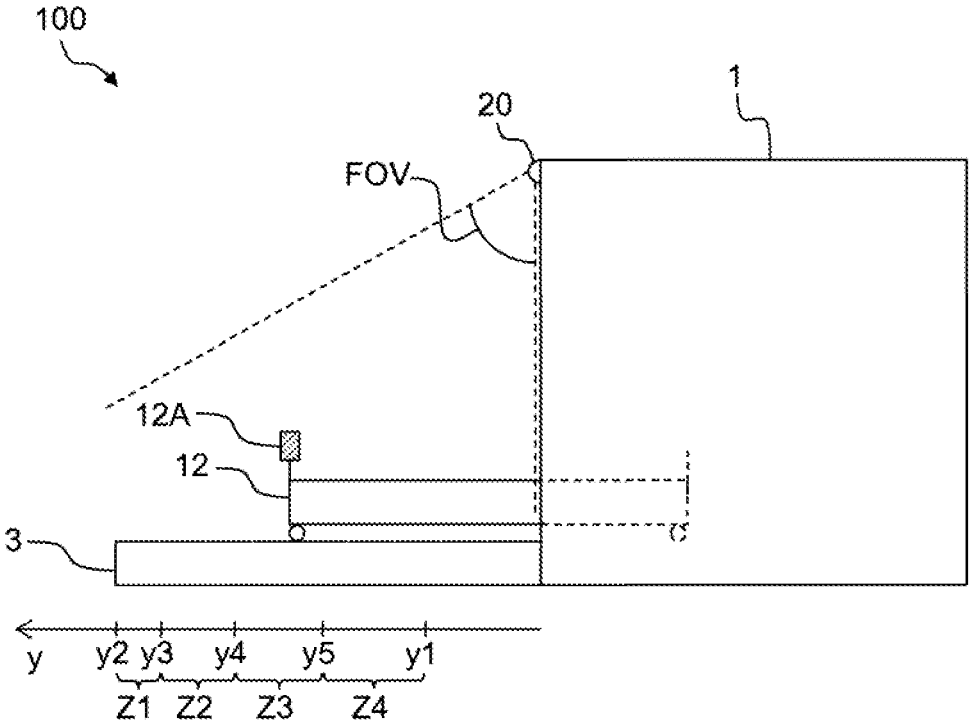
FIG. 4 shows a further schematic side view of a system having a household dishwasher.

FIG. 3 shows a schematic side view of a system 100 having a household dishwasher 1, for example the household dishwasher of FIG. 1. The door 3 is shown in the open position and the lower receptacle 12 for items to be washed is shown in the fully pulled out position (maximum pull-out position). The field of view FOV of the camera 20 is indicated in this side view. The field of view FOV preferably achieved a vertical angle of up to 120° (in the illustration of FIG. 3, the field of view FOV has a vertical angle of about 75°) and a horizontal angle of up to 180° (the horizontal angle is not visible in FIG. 3).

Below the door 3, a Y-axis is shown as an example, with a number of specific points Y1-Y5. The points Y1 and Y2, for example, correspond to those of FIG. 2. Two points each form an interval Z1-Z4, wherein the intervals Z1-Z4 do not overlap: Z1=(Y3; Y2], Z2=(Y4; Y3], Z3=(Y5; Y4], Z4=[Y1; Y5], The summation of the intervals Z1-Z4 includes all pull-out positions between Y1 and Y2. It should be noted that more than four intervals Z1-Z4 or fewer than intervals Z1-Z4 can also be provided. It is apparent that the position of the handle 12A of the receptacle 12 for items to be washed with respect to the Y-axis corresponds directly to the pull-out position of the receptacle 12 for items to be washed.

In FIG. 3, the receptacle 12 for items to be washed is in the maximum pull-out position and the handle 12A is in the interval Z1=(Y3; Y2], In FIG. 4, which shows the same system 100 as FIG. 3, the receptacle 12 for items to be washed is in a middle pull-out position and the handle 12A is in the interval Z3=(Y5; Y4).

Depending upon in which interval Z1-Z4 or at which image position the handle 12A is determined, it can be concluded which partial region W1-W4 (see FIG. 5) of the receptacle 12 for items to be washed is visible on the image IMG (see FIG. 2) of the camera 20.

It should be noted that the above information applies accordingly to the other receptacles 13 and 14 for items to be washed (see FIG. 1).

Figure 5:
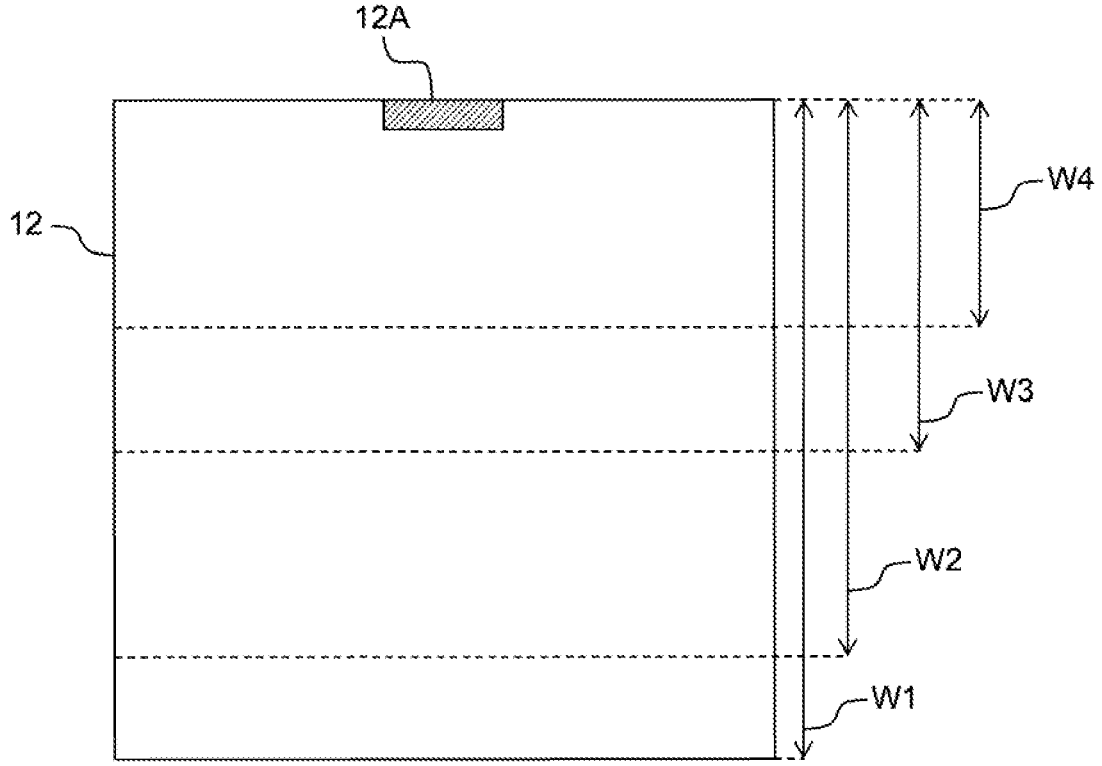
FIG. 5 shows a schematic view of a receptacle for items to be washed with partial regions.

FIG. 5 shows a schematic view of a receptacle 12 for items to be washed with partial regions W1-W4. The partial regions W1-W4 show which part of the receptacle 12 for items to be washed is visible on an image IMG (see FIG. 2) when the handle 12A is in a respective interval Z1-Z4 (see FIG. 3, 4 or 6). When the handle 12A is in the interval Z1, the entire receptacle 12 for items to be washed is visible (partial region W1). When the handle 12A is in the interval Z2, the receptacle 12 for items to be washed is visible, for example, between 90%-50% (partial region W2), wherein the rearmost region of the receptacle 12 for items to be washed (the region opposite the handle 12A) is no longer visible. When the handle 12A is in the interval Z3, the receptacle 12 for items to be washed is visible, for example, between 50%-30% (partial region W3), wherein the rearmost half of the receptacle 12 for items to be washed is no longer visible. When the handle 12A is in the interval Z4, the receptacle 12 for items to be washed is visible, for example, between 30%-0% (partial region W4), wherein the rear half of the receptacle 12 for items to be washed is no longer visible.

It should be noted that the above percentage information is merely for illustrative purposes and is not to be interpreted in a restrictive manner. Which portions of the receptacle 12 for items to be washed are visible on a respective image IMG depends on the one hand on the design of the camera 20, in particular its field of view FOV (see FIG. 3 or 4), and on the other hand on the definition of the intervals Z1-Z4.

Figure 6:
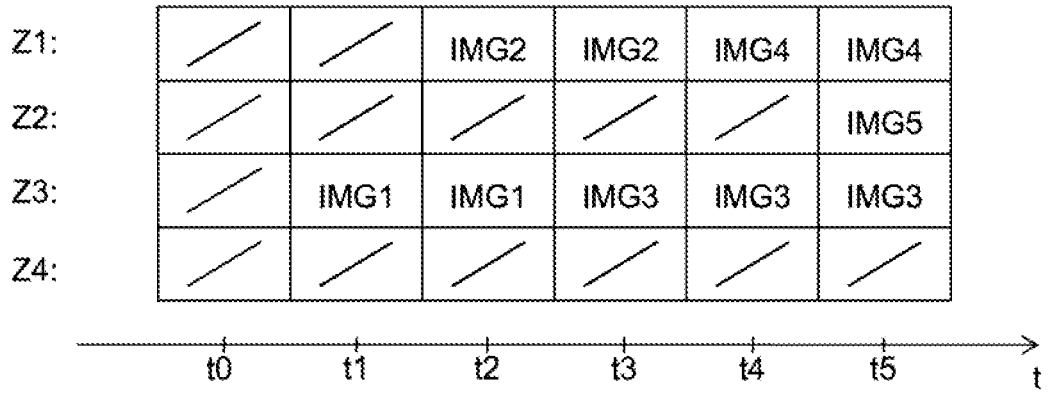
FIG. 6 shows a diagram of a time sequence.

FIG. 6 shows a diagram of a time sequence before the start of a wash program. In the example of FIG. 6, it is assumed that four memory locations are provided for storing four images IMG for a respective receptacle 12 to 14 for items to be washed. Each memory location is assigned an interval Z1-Z4, for example as explained with reference to FIGS. 3 and 4. In further embodiments, more memory locations can be provided.

At an initial time tO, no image IMG is stored at any of the memory locations. At a time t1, a first image IMG1 is captured. The control apparatus 15 (see FIG. 1) determines that the image position of the handle 12A in the captured image IMG1 is in the interval Z3, for this reason the image IMG1 is stored in the memory location that is assigned to the interval Z3. At a time t2, a second image IMG2 is captured. The control device 15 determines that the image position of the handle 12A in the captured image IMG2 is in the interval Z1, for this reason the image IMG2 is stored in the memory location that is assigned to the interval Z1. At a time t3, a third image IMG3 is captured. The control apparatus 15 determines that the image position of the handle 12A in the captured image IMG3 is in the interval Z3, for this reason the image IMG3 is stored in the memory location that is assigned to the interval Z3. In this case, the previously stored image IMG1 is overwritten. At a time t4, a fourth image IMG4 is captured. The control apparatus 15 determines that the image position of the handle 12A in the captured image IMG4 is in the interval Z1, for this reason the image IMG4 is stored in the memory location that is assigned to the interval Z1. In this case, the previously stored image IMG2 is overwritten. At a time t5, a fifth image IMG5 is captured. The control apparatus 15 determines that the image position of the handle 12A in the captured image IMG5 is in the interval Z2, for this reason the image IMG5 is stored in the memory location that is assigned to the interval Z2.

It should be noted that the camera 20 (see FIG. 1, 3 or 4) captures and outputs an image stream, in other words, captures and outputs images at a predetermined frame rate. For example, the frame rate is between 1 FPS (FPS: frame per second) to 30 FPS, preferably between 10 FPS and 15 FPS. If the receptacle 12 for items to be washed remains at a specific pull-out position for a longer time, for example 10 seconds, for example with the handle 12A in the interval Z1, then the currently captured image is stored in each case. In the 10 seconds, a total of 100 images are captured at a frame rate of, for example, 10 FPS. Of these 100 images, only the most recently captured image is permanently stored. It is possible to provide that each of the images is initially stored and then overwritten by the following image, or the images are initially held in a buffer memory until the receptacle 122 for items to be washed is moved further and thus the most current image for the respective pull-out position is known.

After the time t5, the wash program is started. Then the loading of the receptacle 12 for items to be washed (and of the further receptacles 13, 14, if present), for items to be washed is determined first. If images with different time stamps, i.e. different actuality, are available for different partial regions W1-W4 (see FIG. 5), the respectively most recent image IMG is analyzed for a respective partial area W1-W4.

In the present example, three images IMG4, IMG5 and IMG3 are stored at this time. The most recent image IMG5 (time t5), which is stored in the memory location that is assigned to the interval Z2, shows, for example, a partial region W2 of the receptacle 12 for items to be washed. The rearmost region of the receptacle 12 for items to be washed is not visible in this image IMG5. The image IMG4 (time t4), which is stored in the memory location that is assigned to interval Z1, shows the entire receptacle 12 for items to be washed (partial region W1). The image IMG3 (time t3), which is stored in the memory location that is assigned to the interval Z3, shows a partial area W3 of the receptacle 12 for items to be washed. This partial region W3 is encompassed by both the partial region W2 and the partial region W1. Since the capturing time t3 of image IMG 3 is earlier than the capturing time of images IMG4 and IMG5, the image IMG3 is not analyzed because it has outdated information in comparison. The image IMG5 is used to determine the loading for the partial region W2 of the receptacle 12 for items to be washed and the image IMG4 is used to determine the loading for the partial region (W1-W2) not visible in the image IMG5, as explained below with reference to FIG. 7.

The loading is preferably determined by analyzing the entire image in each case and then extracting the relevant regions. It is also possible to extract the partial regions and combine them into one image, which is then analyzed, but this can result in artifacts and distortions because the images have been captured at different times, which can affect the analysis.

Figure 7:
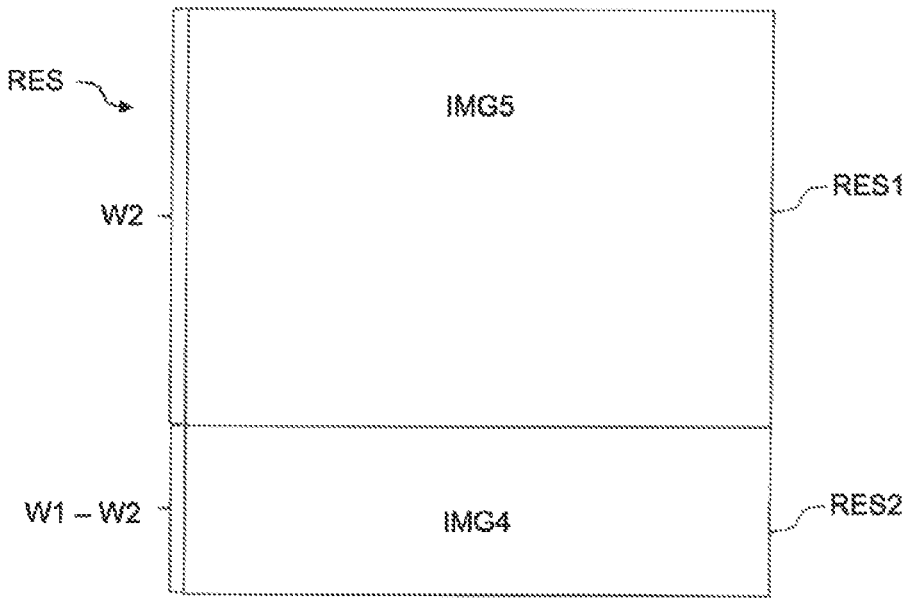
FIG. 7 shows schematically a determined loading based on various images.

FIG. 7 schematically shows a result RES of a loading determination, wherein different images IMG4, IMG5 (see FIG. 6) have been used for different partial regions W2, W1-W2. The result RES comprises two partial results RES1 and RES2. The first partial result RES1 results from an analysis of the image IMG5 on which only the partial region W2 is visible. The part of the result of the analysis of the image IMG5 which does not refer to the receptacle 12 for items to be washed but refers to the door 3, for example, is discarded. The second partial result RES2 results from an analysis of the image IMG4. The parts of the result of the analysis of the image IMG4 that relate to the partial region W2 are discarded because there is a more recent image IMG4 for this partial region, and only the part of the result that relates to the region W1-W2 is used. The overall result RES is composed of the partial results RES1, RES2.

Figure 8:
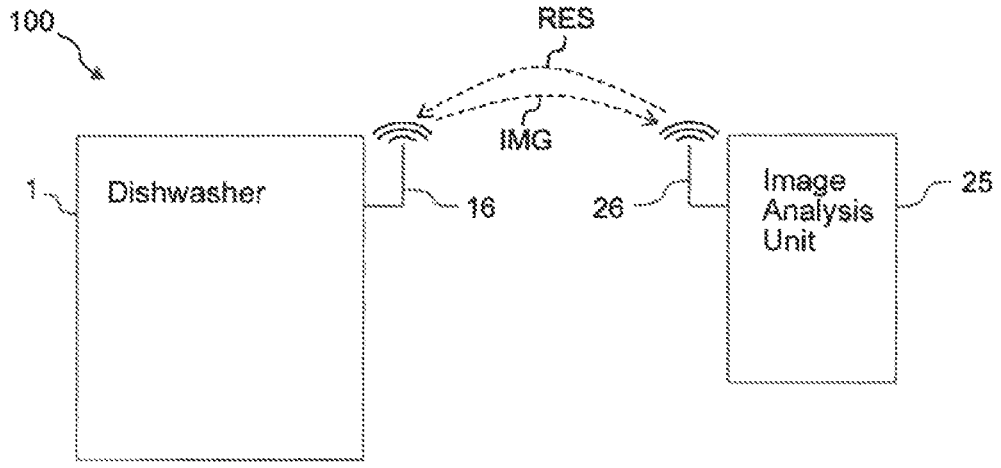
FIG. 8 shows a schematic block diagram of a further embodiment of a system.

FIG. 8 shows a schematic block diagram of a further exemplary embodiment of a system 100. The system 100 comprises an image analysis unit 25 that is arranged externally to a dishwasher 1 (for example, the household dishwasher of FIG. 1 without the image analysis unit shown there). The dishwasher comprises a communication facility 16, by means of which the control device 15 (see FIG. 1) is configured so as to transmit images IMG to the image analysis unit 25 and to receive a result of a load determination RES from the image analysis unit 25. The image analysis unit 25 in turn has a corresponding communication device 26.

The communication facilities 16, 26 are designed, for example, as a modem, as a WLAN adapter, and/or as a mobile radio modem.

Figure 9:
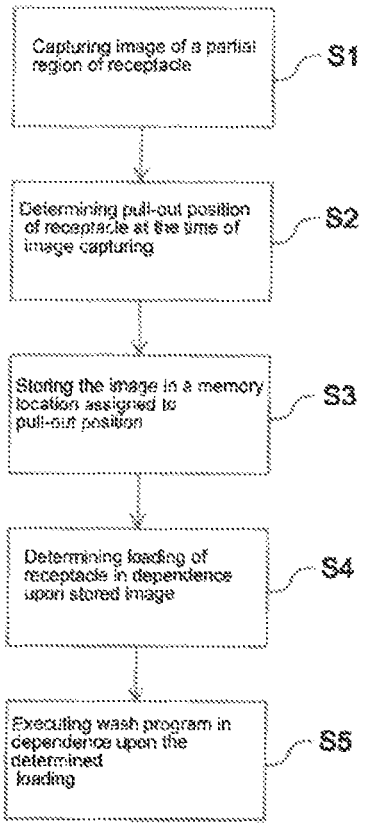
FIG. 9 shows a schematic block diagram of an exemplary embodiment of a method for operating a dishwasher.

FIG. 9 shows a schematic block diagram of an exemplary embodiment of a method for operating a dishwasher 1, for example the household dishwasher of FIG. 1. In a first step S1, an image IMG (see FIG. 2) of at least one partial region W1-W4 (see FIG. 5) of a receptacle 12 for items to be washed (see FIGS. 1-4) of the dishwasher 1 is captured in dependence upon a pull-out position Z1-Z4 (see FIGS. 3-5) of the dish receptacle 12. In a second step S2, the pull-out position Z1-Z4 of the receptacle 12 for items to be washed is determined at the time t1-t5 (see FIG. 5) of image capturing. In a third step S3, the image IMG is stored in a memory location of a number of memory locations that is assigned to the pull-out position Z1-Z4, wherein each memory location of the number is assigned a set of pull-out positions Z1-Z4. In a fourth step S4, a loading RES (see FIG. 7 or 8) of the receptacle 12 for items to be washed is determined in dependence upon the images IMG that are stored in the memory locations. In a fifth step S5, a wash program is executed in dependence upon the determined loading RES.

The method can include various additional steps, such as, for example, determining an image position of a feature of the receptacle 12 for items to be washed, such as a handle 12A, in the captured image IMG, overwriting and/or deleting stored images IMG, discarding captured images IMG based on a detected movement of the receptacle 12 for items to be washed in the captured image IMG, and other steps of the like.

Although the present invention has been described with reference to exemplary embodiments, it can be modified in a variety of ways.

The invention claimed is:

1. A system, comprising:

a dishwasher including a receptacle for items to be washed;

a control apparatus configured to execute a wash program based on a loading of the receptacle with items to be washed;

a camera configured to capture an image of at least one partial region of the receptacle based on a pull-out position of the receptacle, with the captured image being stored by the control apparatus based on the pull-out position in a memory location of a number of memory locations, which memory location is assigned to the pull-out position prior to the camera capturing the image of the at least one partial region, with each of the number of memory locations being assigned a set of pull-out positions; and an image analyzer configured to determine the loading of the receptacle based on images that are stored in the memory locations.

2. The system of claim 1, wherein the dishwasher is embodied as a household dishwasher.

3. The system of claim 1, wherein the control apparatus is configured to identify an image position of a feature of the receptacle in the captured image and to determine the pull-out position of the receptacle based on the identified image position of the feature of the receptacle.

4. The system of claim 3, wherein the control apparatus is configured to identify the image position of the feature of the receptacle based on a region of interest of the image.

5. The system of claim 3, wherein the feature of the receptacle comprises a handle of the receptacle for manually pulling out the receptacle and for manually pushing the receptacle into the dishwasher, and/or the feature of the receptacle comprises a marking that is arranged on the handle.

6. The system of claim 1, wherein the control apparatus is configured to store a most current image of the receptacle at a specific pull-out position in a memory location that is assigned to the specific pull-out position.

7. The system of claim 1, wherein each of the memory locations is assigned a specific interval from the set of pull-out positions of the receptacle.

8. The system of claim 7, wherein at least two memory locations are provided, with a first interval that is assigned to a first one of the at least two memory locations comprising a maximum pull-out position of the receptacle and having a first width, and with a second interval that is assigned to a second one of the at least two memory locations adjoining the first interval and having a second width, wherein the first width is narrower than the second width.

9. The system of claim 1, wherein the camera is configured to capture an image stream of the receptacle, wherein two temporally successive images in the image stream have a predetermined temporal spacing, said control apparatus configured to determine a movement of the receptacle based on the two successive images of the image stream and to store one of the two successive images based on the determined movement of the receptacle.

10. The system of claim 1, wherein the image analyzer is configured to determine the loading of the receptacle based on a capturing time that is assigned to a respective one of the stored images and the pull-out positions that are assigned to the memory location, wherein a first one of the stored images, in which a specific partial region of the receptacle is visible and whose capturing time is more recent than the capturing time of a second one of the stored images in which the specific partial region of the receptacle is also visible is used to determine a loading for the specific partial region of the receptacle.

11. The system of claim 1, wherein the control apparatus is configured to delete an image whose capturing time is earlier than a predetermined threshold value.

12. The system of claim 1, wherein the control apparatus is configured to set the camera into a sleep mode at an end of a predetermined time interval in which a state of the receptacle is constant.

13. The system of claim 1, wherein the image analyzer is arranged in a facility that is external to the dishwasher, with the control apparatus and the image analyzer being configured to transmit data to each other.

14. The system of claim 1, wherein the image analysis analyzer is configured to determine a type, a quantity, an orientation, an arrangement and/or a material of each item to be washed that is arranged in the receptacle.

15. A method for operating a dishwasher, said method comprising:

capturing, by a camera, an image of at least one partial region of a receptacle for items to be washed of the dishwasher based on a pull-out position of the receptacle;

determining, by a control apparatus, the pull-out position of the receptacle at a time of capturing the image;

storing, by a control apparatus, the image in a memory location of a number of memory locations that is assigned to the pull-out position prior to capturing the image of the at least one partial region, wherein each of the memory locations is assigned a set of pull-out positions;

determining, by an image analyzer a loading of the receptacle based on images that are stored in the memory locations; and executing, by a control apparatus, a wash program based on the determined loading.

16. The method of claim 15, wherein the dishwasher is a household dishwasher.

17. A computer program product, embodied on a non-transitory computer readable medium comprising instructions which, when executed by a computer, cause the computer to perform a method as set forth in claim 15.

18. The system of claim 1, wherein the image analyzer is configured to determine the loading of the receptacle by determining a respective partial result corresponding to each partial region of the receptacle, and wherein the loading corresponds to an overall result determined by the image analyzer that comprises each partial result.

* * * * *